United States Patent [19]

Zaremski

[11] 4,415,415

[45] Nov. 15, 1983

[54] METHOD OF CONTROLLING OXIDE SCALE FORMATION AND DESCALING THEREOF FROM METAL ARTICLES

[75] Inventor: Donald R. Zaremski, Cheswick, Pa.

[73] Assignee: Allegheny Ludlum Steel Corporation, Pittsburgh, Pa.

[21] Appl. No.: 444,128

[22] Filed: Nov. 24, 1982

[51] Int. Cl.[3] ..... C25F 1/04; C25F 1/06

[52] U.S. Cl. ..... 204/141.5; 204/145 R

[58] Field of Search ..... 204/141.5, 145 R

[56] References Cited

U.S. PATENT DOCUMENTS

| | | | |
|---|---|---|---|
| 3,043,758 | 7/1962 | Machu | 204/145 |
| 3,254,011 | 5/1966 | Zaremski | 204/140.5 |
| 3,260,619 | 7/1966 | Shoemaker et al. | 134/3 |
| 4,012,299 | 3/1977 | Zaremski et al. | 204/141.5 |
| 4,026,777 | 5/1977 | Zaremski et al. | 204/141.5 |
| 4,066,521 | 2/1978 | Zaremski et al. | 204/145 R |

OTHER PUBLICATIONS

U.S. Application Ser. No. 238,896, filed Feb. 27, 1981.

*Primary Examiner*—T. M. Tufariello

*Attorney, Agent, or Firm*—Patrick J. Viccaro

[57] ABSTRACT

A process is provided for removing an oxide scale from the surface of a metal article and a process for the manufacture of metal articles which controls oxide scale formation and descaling thereof. A process includes providing an oxygen content of the thermal treatment atmosphere of at least 3.0%, by volume, after hot and cold forming to control the oxide scale formed. The descaling process includes immersing the article in an electrolyte of an aqueous solution of at least one neutral salt from the group consisting of the chloride, sulfate and nitrate of an alkali metal or ammonium, adjusting and maintaining a pH of 2.0 to 3.5 and passing a low density electric current through the immersed article. The article has an oxide scale substantially equivalent to an oxide scale formed at least in part in an oxidizing atmosphere of at least 3.0% oxygen, by volume. The processes may include the step of immersing in a mild acid solution to substantially remove the scale.

17 Claims, 1 Drawing Figure

METHOD OF CONTROLLING OXIDE SCALE FORMATION AND DESCALING THEREOF FROM METAL ARTICLES

BACKGROUND OF THE INVENTION

This invention relates to a metallic descaling process. More particularly, it relates to a process for controlling oxide scale formation and descaling thereof from metal articles.

In the process of manufacturing metal articles from the melt stage to a finished strip product such as flat rolled strip and sheet, bar, wire and tubular products, such processing frequently includes thermal treatments including heating or annealing in oxidizing furnace atmospheres to temperatures at which oxide scale readily forms on the article surface of various metal alloys including stainless steel alloys. To be used in conjunction with continuous annealing or heating processes, a scale removing bath must be of sufficient strength to remove the scale as rapidly as the strip emerges from the furnace. As the speed of the strip cannot be changed to accommodate the scale removal process and equipment, the scale removal process must quickly and efficiently condition and loosen the scale to facilitate removal. Generally, there are three different descaling processes which may be used: (1) a shot blasting plus an acid pickling; (2) a molten oxidizing salt or electrolytic scale conditioning followed by an acid pickling; and (3) a straight acid pickling process.

U.S. Pat. No. 3,043,758, issued July 10, 1962, discloses an electrolytic descaling and pickling process for stainless steel wherein the article to be descaled is subjected as an anode in an aqueous electrolyte of at least one neutral salt selected from a group consisting of chloride, sulfate and nitrate of an alkali metal including ammonium and thereafter dipping the article in a solution of mineral acid selected from the group consisting of sulfuric, nitric and hydrofluoric acid and mixtures of nitric and hydrofluoric acids. The electrolyte of the process is maintained at a pH of 1–7, and preferably 3.5–7 and nominally 5.5, and at a temperature ranging from 167°–194° F. (75°–90° C.) and subjected to an electric current for 10–60 seconds at a current density of 6–10 A/dm$^2$ (0.38–0.64 A/in$^2$).

Another electrolytic descaling process including a step of dilute acid immersion is disclosed in U.S. Pat. No. 3,254,011, issued May 31, 1966.

It is also known to use molten oxidizing salts to condition and loosen the scale and facilitate its removal. A typical process is disclosed in U.S. Pat. No. 3,260,619, issued July 12, 1966. Such molten salt baths generally require operating temperatures from 800°–1000° F. (426.7° to 537.8° C.) to condition and remove the scale and may be followed by a dilute acid pickling step. Although the high temperature salt baths are effective to loosen oxide scale, they also present numerous problems. Such processes require higher operating costs, and may result in strip distortion, punch marking, surface scratching and other chemical attacks of a strip or sheet. They also have the additional disadvantages of attacking the various components of equipment required to retain the salt and guide the strip through the bath, such as tank linings, rolls and the like, which, in turn, can cause warping and distortion, especially of lighter gauge strip.

Attempts have also been made to minimize or eliminate the subsequent acid pickling bath from descaling processes. The use of an acid pickle step requires auxiliary equipment including exhaust systems, fume scrubbers, acid storage tanks and the like and also require elaborate programs for disposal of the acids. Thus, processes which eliminate or minimize the need for acid pickling are desirable. U.S. Pat. No. 4,012,299, issued Mar. 15, 1977, discloses such a descaling process requiring immersion into a first electrolyte, followed by a rinse and a subsequent immersion into a second electrolyte including at least one neutral salt such as sodium sulfate without the need of a subsequent acid pickling step. The patent also discloses that the second electrolyte has a pH ranging from 1–7 at a temperature of 120°–200° F. (48.9° to 93.3° C.) and be subjected to an electric current for more than four seconds having a current density greater than 0.1 A/in$^2$ (1.55 A/dm$^2$). Such a process has its disadvantages in that the first electrolyte is a molten oxidizing salt maintained from 400° to 450° F. (204.4° to 232.2° C.) and presents the numerous problems associated with such salts as described above.

Two other processes designed to eliminate the acid pickling step are disclosed in U.S. Pat. Nos. 4,026,777, issued May 31, 1977, and 4,066,521, issued Feb. 3, 1978. Both processes require a two-step process wherein the first step includes immersion in a bath of molten oxidizing salt. Such processes have the disadvantages associated with the higher operating temperatures of the molten oxidizing salt baths.

It has also been suggested in a U.S. patent application Ser. No. 238,896, filed Feb. 27, 1981, that a one-step high current density descaling process can be used to remove oxide scale with no pre- or post-treatment and no acid pickling. The process includes using a 15–25% sodium sulfate electrolyte maintained at a temperature of at least 150° F. and passing an electric current through the body in the electrolyte at a current density of at least 3 A/in$^2$ (46.5 A/dm$^2$) for at least ten seconds and following with a water rinse. Such a high current density process, however, is particularly suited for small items such as tubing, wherein the anode lengths may be 4 to 6 feet and the total number of amperes required for a descaling process are relatively low. However, for strip mills, and particularly strip mills for wide strip, an anode may approach 40 feet in length. In such a descaling process, the total number of amperes used for descaling is far greater and the attending cost of such a high current density process may be practically prohibitive.

What is needed, therefore, is a descaling process which minimizes or reduces the need for an acid pickling step and all the problems and costs associated therewith. An electrolytic process should be a low current density process suitable for descaling continuous strip products. In meeting those objectives, it has been unexpectedly recognized that a process that controls the scale formation on the metal articles during manufacturing processes may provide a scale that is more easily removed. In conjunction therewith, a process which optimizes current descaling processes, such as a sodium sulfate electrolyte process followed by minimal acid concentration pickling, and which provides more efficient and less costly descaling in the manufacture of a more uniform product is also desirable.

SUMMARY OF THE INVENTION

In accordance with the present invention, a process is provided for the manufacture of metal articles comprising hot forming, cold forming and subsequently thermally treating in an oxidizing atmosphere wherein the process further comprises providing an oxygen content of the atmosphere of at least 3.0%, by volume, to control the oxide scale formed on the metal article. The scale is then subsequently removed by immersing the article in an electrolyte of an aqueous solution of at least one neutral salt from the group consisting of the chloride, sulfate and nitrate of an alkali metal or ammonium, the pH of the electrolyte being adjusted to and maintained from about 2.0 to 3.5, passing a low density electric current through the article in the electrolyte to condition the scale for removal and removing the article from the electrolyte. The method may include immersing the article in a mild acid solution, the acid selected from the group consisting of sulfuric, nitric and hydrofluoric acid and mixtures of nitric and hydrofluoric acids to substantially remove the scale.

Also provided is a process for removing an oxide scale from the surface of a metal article, including immersing the article in an electrolyte of an aqueous solution of at least one neutral salt from the group consisting of chloride, sulfate and nitrate of an alkali metal or ammonium, the pH of the electrolyte being adjusted to and maintained from about 2.0 to 3.5, and the article having an oxide scale substantially equivalent to an oxide scale formed at least in part in an oxidizing atmosphere of at least 3.0% oxygen, by volume. The process includes passing a low density electric current through the article in the electrolyte to condition the scale for removal and removing the article from the electrolyte. The process may include immersing the article in a mild acid solution, the acid selected from the group consisting of sulfuric, nitric and hydrofluoric acid and mixtures of nitric and hydrofluoric acids to substantially remove the scale.

In preferred embodiments, the oxidizing atmosphere may have an oxygen content ranging from 3–11% and the electrolyte may be maintained at a temperature of 150°–185° F. (65.6° to 85° C.). A current density of about 0.1–1.0 A/in$^2$ may be used. The mild acid solution contains less than 10% concentration of an acid.

DETAILED DESCRIPTION OF THE PREFERRED EMBODIMENTS

Figure 1:
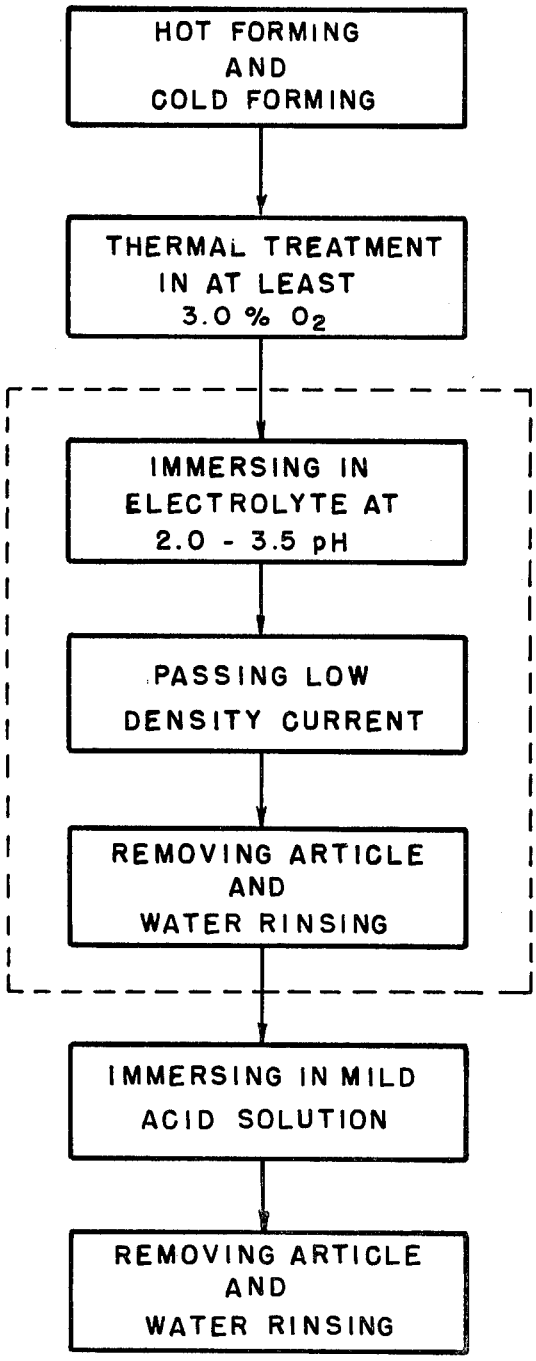
FIG. 1 is a flow diagram of the typical steps of the processes of the present invention.

The present invention relates to a process for the manufacture of metal articles which controls the oxide scale formation and includes a process for descaling the oxide from the articles through a unique combination of variable controls of the oxygen content of the oxidizing atmosphere used in the thermal treatments and the control of the pH of the electrolyte in the descaling process for the removal of scales from the metal articles which eliminate or minimize the need for acid pickling.

As shown in FIG. 1, a flow diagram illustrates typical steps in the process for manufacture of a metal article including a process for descaling (shown in the dotted line box) of the present invention.

The descaling process includes the step of immersing the article in an electrolyte of an aqueous solution of at least one neutral salt from the group consisting of the chloride, sulfate and nitrate of an alkali metal or ammonium. Preferably, the electrolyte is an aqueous solution of sodium sulfate. The sodium sulfate electrolyte may have a solution concentration of sodium sulfate ranging from 7–25% and more preferably 15–20%. It is within the scope of the present invention that a process may include one or more additional electrolytic oxide scale conditioning and descaling steps which facilitate the objectives of eliminating or minimizing an acid pickling step.

A low density electric current is passed through the metal article which is immersed in the electrolyte to condition the scale for removal. The current density may range from 0.1 up to 1.0 A/in$^2$ (1.55 to 15.5 A/dm$^2$) and preferably may range from 0.2–0.5 A/in$^2$ (3.10 to 7.75 A/dm$^2$). Accordingly, the current flux may range from 1.0–25.0 amp-secs/in$^2$ and preferably may range from 2.5–12.0 amp-secs/in$^2$. It appears that chromium-nickel and chromium-nickel-manganese alloys require slightly higher current densities and current flux than does a straight-chromium alloy. As with any electrolytic process, however, immersion times are dependent upon the size of the body being descaled, as well as the type and thickness of the scale, and the temperature of the electrolyte.

Electrolyte temperatures are usually in the range of 120° to 200° F., however, for the present invention, it is preferred that the temperature range from 150° to 185° F. (65.6° to 85° C.) and even more preferably 160° to 180° F. (71.1° to 82.2° C.).

After the article is removed from the electrolyte, it may be water rinsed and immersed in a mild acid solution to substantially remove the scale. The acid is selected from the group consisting of sulfuric, nitric and hydrofluoric acid and mixtures of nitric and hydrofluoric acids. As is conventional, it is preferred to use mixtures of nitric and hydrofluoric acids. Preferably, those acids and mixtures thereof have a solution concentration of less than 10%, by weight, and more preferably less than 8%, by weight. The acid temperatures may range from 100° to 160° F. (37.8° to 71.1° C.) and preferably 130° to 150° F. (54.4° to 65.6° C.). Such an acid pickling step is necessary if no other electrolytic or non-acid or subsequent descaling treatments are used. The article is water rinsed after the acid pickling.

It has been found that in such a descaling process, the acidity of the salt electrolyte is critical to the efficiency of the descaling process. Preferably, the pH may range from 2.0 to 3.5, and more preferably from 2.0 to 3.0. Adjusting to and maintaining such lower pH's have been found to improve the scale conditioning processes, particularly in electrolytic sodium sulfate processes. The electrolyte may be acidified, such as by adding some acids, such as sulfuric acid, in relatively minor amounts to adjust the pH value.

Although the invention is believed to be adaptable to a variety of metals, alloy steels presently appear to constitute the most significant embodiment thereof. Furthermore, stainless steels, such as Types 201, 304, 316, 409 and 413, appear particularly suited to the process of the present invention.

The criticality of the pH of the electrolytic solution was studied in a series of controlled laboratory experiments for removing scale from small size samples.

Samples of mill-annealed Type 304 stainless steel strip having been conventionally hot formed and cold formed were annealed in a gas-fired furnace having an atmosphere containing 7.4% oxygen. The samples were treated individually as an anode in a 20% sodium sulfate solution ($Na_2SO_4$) at about 170° F. (76.7° C.) for times ranging from 15 to 90 seconds and at current densities of 0.25 and 0.50 A/in$^2$ (3.875 and 7.75 A/dm$^2$). The results of the tests are shown in Table 1 for a pH of the sulfate electrolyte adjusted to and maintained at 2.5 in one series of test and at 5.5 pH in a second series of tests. The samples were examined subsequent to each treatment and visual estimates were made for the degree of scale removal attained after further post-treating by either (1) water rinsing only; (2) water rinsing and brush scrubbing; or (3) water rinsing plus acid pickling in an 8% nitric acid and 1% hydrofluoric acid solution for 60 seconds at 140° F. (45.8° C.).

TABLE NO. 1

ELECTROLYTIC SODIUM SULFATE DESCALING EFFECTS OF SOLUTION pH*

| Sample No. | Current Density (Anodic) | Time | Percent Descaled @ pH 2.5 Rinsed | Scrubbed | Pickled | @ pH 5.5 Rinsed | Scrubbed | Pickled |
|---|---|---|---|---|---|---|---|---|
| 1 | 0.25 amp/in$^2$ | 15 secs | 5% | 25% | 70% | 5% | 15% | 60% |
| 2 | " | 30 secs | 25% | 45% | 95% | 10% | 20% | 60% |
| 3 | " | 45 secs | 75% | 80% | 100% | 30% | 30% | 70% |
| 4 | " | 60 secs | 75% | 80% | 100% | 30% | 30% | 100% |
| 5 | " | 90 secs | 80% | 80% | 100% | 35% | 50% | 100% |
| 1A | 0.50 amp/in$^2$ | 15 secs | 15% | 35% | 85% | 10% | 10% | 60% |
| 2A | " | 30 secs | 80% | 85% | 100% | 20% | 30% | 85% |
| 3A | " | 45 secs | 90% | 90% | 100% | 35% | 35% | 100% |
| 4A | " | 60 secs | 90% | 95% | 100% | 40% | 45% | 100% |

*Solution: 20% $Na_2SO_4$, 170° F. (76.7° C.).

It is clear from the data that the sulfate electrolyte having the lower pH values were more effective in both scale conditioning and partially removing annealing scales from the stainless steels. For each of the post-treatment categories (rinsed, scrubbed or pickled), the electrolyte having a pH of 2.5 produced a greater amount of scale removal for practically every common current density and treatment time applied. The data also shows that where complete descaling was obtained by acid pickling, the scale conditioning leading to such removal was accomplished at lower current densities and in less time than when using the more acid sulfate solution.

In addition to controlling the pH of the electrolyte solution, it has been found that the descaling process can be enhanced if the scale formation is controlled during the heat treating or annealing steps in an oxidizing atmosphere. It has unexpectedly been found that the oxygen content of the oxidizing atmosphere is critical in that it affects the scale formed such that if the oxygen content of the atmosphere is controlled and the pH of the electrolyte is controlled, a manufacturing process can be provided which minimizes the pickling step in acid.

The present invention relates to a process for manufacturing a metal article which includes providing an oxygen content of the oxidizing atmosphere during thermal treatments of at least 3.0%, by volume, to control the oxide scale formed on the metal article. Preferably, the oxygen content of the atmosphere may range from 3 up to 11%. It is intended that the oxide scale formed on the article should be substantially equivalent to an oxide scale formed at least in part in an oxidizing atmosphere of at least 3.0% oxygen, by volume.

Samples of mill-annealed stainless steel strip of various alloys following conventional hot forming and cold forming were annealed in a gas-fired furnace having oxygen contents ranging from 2.0 to 10.8% oxygen, by volume. The samples were treated individually as anodes in 20% sodium sulfate solution electrolyte maintained at 170° F. (76.7° C.) and adjusted to and maintained at a pH of 2.5 for times ranging from 20 to 44 seconds and at current densities of 0.25 and 0.5 A/in$^2$ (3.875 and 7.75 A/dm$^2$). Subsequent to the scale conditioning, the samples were water rinsed and immersed in an acid solution of 8% nitric acid and 1% hydrofluoric acid maintained at 140° F. (60° C.) to substantially remove the scale and followed by a water rinse. The results of the tests are shown in Table 2.

TABLE NO. 2

ELECTROLYTIC SODIUM SULFATE DESCALING EFFECTS OF OXYGEN CONTENT

| Grade | Gage | Furnace $O_2$ | Required Sulfate Treatment* Current Density | Time | Amp-secs/In$^2$ Total | Acid Pickle** Time |
|---|---|---|---|---|---|---|
| 201 | .025" | 6.8% | 0.25 amp/in$^2$ | 28 secs | 7 amp-secs/in$^2$ | 56 secs |
| 304 | .035" | 6.2% | 0.25 amp/in$^2$ | 36 secs | 9 amp-secs/in$^2$ | 72 secs |
| 304 | .050" | 5.7% | 0.25 amp/in$^2$ | 36 secs | 9 amp-secs/in$^2$ | 72 secs |
| 304 | .029" | 2.3% | 0.5 amp/in$^2$ | 44 secs | 21 amp-secs/in$^2$ | 88 secs |
| 304 | .072" | 2.0% | 0.5 amp/in$^2$ | 44 secs | 21 amp-secs/in$^2$ | 88 secs |
| 316 | .030" | 8.1% | 0.5 amp/in$^2$ | 24 secs | 12 amp-secs/in$^2$ | 48 secs |
| 409 | .034" | 8.5% | 0.25 amp/in$^2$ | 20 secs | 5 amp-secs/in$^2$ | 40 secs |
| 413 | .073" | 2.7% | 0.5 amp/in$^2$ | 28 secs | 14 amp-secs/in$^2$ | 56 secs |

*Solution: 20% $Na_2SO_4$, 170° F. (76.7° C.), pH 2.5
**Solution: 8% $HNO_3$ + 1% HF, 140° F. (60° C.)

All of the strip samples processed showed complete descaling when examined after high pressure water rinsing and hot air drying. As shown in Table 2, the scale conditioning requirements to effect substantial removal of the scale varied. The cause of the variation in requirements was due to the nature of the different oxide scales on the metal surface which was observed to be influenced by the oxygen content of the oxidizing atmosphere in the furnace used in the annealing operation. Generally, the oxide scales which formed in atmospheres having less than 3% oxygen, by volume, were found to require higher current densities and/or longer anodic treatment times in the conditioning electrolyte before complete scale removal could be attained in the final acid pickle step. It is clear from the data that higher oxygen contents of greater than or equal to 3% oxygen lessen these requirements and showed lower current densities and/or shorter anodic treatment times. The data further substantiated that it was necessary to maintain electrolyte at a low pH value and particularly showed the preference for lower pH values, such as 2.5.

In accordance with the objectives of the present invention, it has been found that through exercising controls on the oxygen content of the annealing furnace atmosphere and the electrolyte pH, it has been possible to effectively remove oxide scales on stainless steel strip caused by thermal treatments with a minimal need for mixed acid pickling, particularly in nitric and hydrofluoric acid mixtures. It has also been demonstrated that when acid pickling is used an over reduction in acid consumption of at least greater than 25% and greater than 50% is possible with the processes of the present invention.

Although several embodiments of the present invention have been shown and described, it will be apparent to those skilled in the art that modifications may be made therein without departing from the scope of the present invention.

What is claimed is:

1. A process for the manufacture of a metal article comprising hot forming, cold forming and subsequently thermally treating in an oxidizing atmosphere, the process further comprising:

providing an oxygen content of the atmosphere of at least 3.0%, by volume, to control the oxide scale formed on the metal article;

immersing the article in an electrolyte of an aqueous solution of at least one neutral salt from the group consisting of the chloride, sulfate and nitrate of an alkali metal or ammonium, the pH of the electrolyte being adjusted and maintained from about 2.0 to 3.5;

passing a low density electric current through the article in the electrolyte to condition the scale for removal; and removing the article from the electrolyte.

2. The process as set forth in claim 1 wherein after removing the article, then immersing the article in a mild acid solution, the acid selected from the group consisting of sulfuric, nitric and hydrofluoric acid and mixtures of nitric and hydrofluoric acids to substantially remove the scale.

3. The process as set forth in claim 2 including a subsequent step of water rinsing the descaled article.

4. The process as set forth in claim 1 wherein the oxygen content of the oxidizing atmosphere ranges from 3–11%.

5. The process as set forth in claim 1 including maintaining the electrolyte at a temperature of 150°–185° F.

6. The process as set forth in claim 1 including passing a low density electric current of about 0.1–1.0 A/in$^2$.

7. The process as set forth in claim 6 wherein the current density is about 0.2–0.5 A/in$^2$.

8. The process as set forth in claim 1 wherein the mild acid solution has a concentration of less than 10% acid.

9. A process for the manufacture of a stainless steel article comprising hot forming, cold forming and subsequently thermally treating in an oxidizing atmosphere, the process further comprising:

providing an oxygen content of the atmosphere of at least 3.0% and up to 11%, by volume, to control the oxide scale formed on the steel article;

immersing the steel article in an electrolyte of an aqueous solution of about 15–25%, by weight, sodium sulfate;

adjusting and maintaining the electrolyte at a pH of about 2.0 to 3.5 and maintaining at a temperature of 150°–185° F.;

passing a low density electric current of about 0.1–1.0 A/in$^2$ through the steel article in the electrolyte to condition the scale for removal;

removing the steel article from the electrolyte; and immersing the steel article in an acid solution of less than 10% concentration of an acid selected from the group consisting of nitric and hydrofluoric acid and mixtures thereof to substantially remove the scale.

10. A process for removing an oxide scale from the surface of a metal article, the process comprising:

immersing the article in an electrolyte of an aqueous solution of at least one neutral salt from the group consisting of chloride, sulfate and nitrate of an alkali metal or ammonium, the pH of the electrolyte being adjusted to and maintained from about 2.0 to 3.5, the article having an oxide scale equivalent to an oxide scale formed at least in part in an oxidizing atmosphere of at least 3.0% oxygen, by volume;

passing a low density electric current through the article in the electrolyte to condition the scale for removal; and removing the article from the electrolyte.

11. The process as set forth in claim 10, wherein after removing the article, then immersing the article in a mild acid solution, the acid selected from the group consisting of sulfuric, nitric and hydrofluoric acid and mixtures of nitric and hydrofluoric acids to substantially remove the scale.

12. The process as set forth in claim 11 including a subsequent step of water rinsing the descaled article.

13. The process as set forth in claim 10 wherein the oxygen content of the oxidizing atmosphere ranges from 3–11%.

14. The process as set forth in claim 10 including maintaining the electrolyte at a temperature of 150°–185° F.

15. The process as set forth in claim 10 including passing a low density electric current of about 0.1–1.0 A/in$^2$.

16. The process as set forth in claim 15 wherein the current density is about 0.2–0.5 A/in$^2$.

17. A process for removing an oxide scale from the surface of a stainless steel article, the process comprising:

immersing an article in an electrolyte of an aqueous solution of about 15–25%, by weight, sodium sulfate, the article having an oxide scale equivalent to an oxide scale formed at least in part in an oxidizing atmosphere of at least 3.0% oxygen, by volume;

adjusting and maintaining the electrolyte at a pH of about 2.0 and 3.5 and maintaining at a temperature of 150°–185° F.;

passing a low density electric current of about 0.1–1.0 $A/in^2$ through the steel article in the electrolyte to condition the scale for removal;

removing the article from the electrolyte; and immersing the article in an acid solution of less than 10% concentration of an acid selected from the group consisting of nitric and hydrofluoric acid and mixtures thereof to substantially remove the scale.

* * * * *